United States Patent [19]

Hobbelt et al.

[11] Patent Number: 4,802,662

[45] Date of Patent: Feb. 7, 1989

[54] PROCESS AND DEVICE FOR REMOVING THE TOP PLY FROM A STACK OF PLIES SUCH AS LAYERS OF FABRIC

[75] Inventors: Hendrik J. H. Hobbelt, Almelo; Eduard A. Burgemeister, Sprang/Capelle; Theodorus J. P. M. Kroon, Aalten, all of Netherlands

[73] Assignee: Research-Vereniging Nededlandse Kleding-En Tricotage-Industrie(RNKT), Netherlands

[21] Appl. No.: 902,608

[22] Filed: Sep. 2, 1986

[30] Foreign Application Priority Data

Sep. 2, 1985 [NL] Netherlands ..... 8502400

[51] Int. Cl.[4] ..... B65H 3/60

[52] U.S. Cl. ..... 271/20; 271/19; 271/105; 38/14; 38/63

[58] Field of Search ..... 271/19, 20, 97, 105, 271/106, 107; 38/14, 15, 63, 67, 69, 70

[56] References Cited

U.S. PATENT DOCUMENTS

| | | | |
|---|---|---|---|
| 734,670 | 7/1903 | Cleathero | 271/20 X |
| 1,460,336 | 6/1923 | Hart | 271/20 |
| 1,546,184 | 7/1925 | Aldrich | 271/20 |
| 4,635,917 | 1/1984 | Granot et al. | 271/97 |

FOREIGN PATENT DOCUMENTS

| | | |
|---|---|---|
| 806542 | 10/1973 | Belgium . |
| 0019543 | 11/1980 | European Pat. Off. . |
| 2330365 | 6/1972 | Fed. Rep. of Germany . |
| 295100 | 4/1965 | Netherlands . |
| 7103678 | 9/1972 | Netherlands . |

*Primary Examiner*—Andres Kashnikow
*Assistant Examiner*—Matthew C. Graham
*Attorney, Agent, or Firm*—McGlew and Tuttle

[57] ABSTRACT

Processes for removing the top ply from a stack of plies, such as layers of fabric, in which an element engages the stack and moves relative to the ply to be removed along the face of said ply while pressure is inserted by the element on the stack in such a way that this is locally dented. The element used to engage the ply is provided with a smooth surface. The invention also relates to a device for carrying out this method having a single hollow element which is provided with suction openings or blow openings and can be moved perpendicular to its longitudinal axis.

4 Claims, 2 Drawing Sheets

5
4
6
6
3
1
2

5
4
8
11
9
7
3
1
2

PROCESS AND DEVICE FOR REMOVING THE TOP PLY FROM A STACK OF PLIES SUCH AS LAYERS OF FABRIC

The invention relates to a process for removing the top ply from an elastically compressible stack of plies, by having an element engage the stack and move it relative to the ply to be removed along the face of said ply. Such a process is known from, for example, Belgian Patent 806542.

Layers of fabric can be of very different kinds. They can have a smooth surface or a rough surface, and the friction between the layers can be small or great. In clothing manufactories these layers or plies stacked on top of one another, are removed one by one to be further processed in the making of an article of clothing. The known process serves to automate the removal of the plies or layers. The known process is based on the idea that the top ply must be displaced by means of friction relative to the ply below it in order to produce a bulging and/or displacement beyond the edge, so that it can be grasped with a gripper, which then removes the top layer and deposits it at the desired place. The basic idea here is that slipping between element and ply may not occur, which means that the element engaging the ply of fabric must have a rough surface. However, this often leads to damage of the ply of fabric.

An attempt was therefore made to remove the plies one by one with suction nozzles, but the disadvantage of these again is that there is no certainty of avoiding the removal of more than one ply.

The object of the invention is then to provide a process by which it is possible to remove the plies one by one without the risk of damage and regardless the type of fabric of the plies.

This object is achieved according to the invention in that the element with a smooth surface engages the ply and presses in such a way on the stack that said stack is locally dented.

According to the invention, a smooth element is therefore now used, and this smooth element is pressed on the stack of plies in such a way that a dent is produced.

This dent results in tension being produced in the ply on either side of the element. If the element is now displaced at the same time, tautening takes place behind the element, viewed in the direction of movement, and a reduction in tension takes place in front of the element, which leads to a bulge.

What is meant by a smooth surface of the element is a surface where the friction between the element and the top ply is less than the friction between the individual plies. With a rough surface the friction between the element and the top ply is in fact greater than the friction between the plies.

The use of a smooth surface which engages the top ply in accordance with the process according to the invention results in slipping, while the bulge is still produced.

While with the above-described known process there is engaging on the top ply with a rough surface which exerts practically no pressure on the ply, i.e. a pressure which is just sufficient to cause the friction and take the ply away, according to the invention the opposite is now done, i.e. a smooth surface engages the top ply and the stack is dented by the element.

It is surprising that in this way a clear separation can be produced between the plies and there is no risk of damage.

According to the invention it can be advantageous if the element is moved over and in pressing contact with the stack from an initial position on top of the stack to an edge of the stack, the element is then returned, without the exertion of pressure, to or near to this initial position and while a vacuum is produced above the stack by means of a jet of air directed onto a plate arranged with an upward inclination with respect to the element in the direction of said edge, in such a way that the top ply is lifted by the vacuum. The sliding movement and pressing load then results in the layers being shifted in the direction of the movement, with the top layer the furthest, so that at the edge a stepwise arrangement of the layers is produced. When the element is subsequently returned to the initial position and a vacuum is produced under the said plate by the jet of air which at the edges of the plate sucks air out of the area under the plate, the top ply will be lifted and will move to the underside of the plate. The edge thereof can then easily be grasped by a gripper, especially since the said edge is projecting due to the displacement.

It is pointed out that it is known per se from British Patent Specification 1,055,785 to use for a stack of plies of fabric a jet of air which is directed onto the top surface of a bent plate, thereby producing a lower pressure under the plate and thus lifting the top ply. Here, however, there is no movement of the element. The freed edge has to be gripped by a suction device in this known process.

The invention also relates to a device for carrying out the process according to the invention, and this device can consist of a single hollow element which is provided with suction openings or blow openings, and which can be moved perpendicular to its longitudinal axis. It is therefore conceivable to use a pipe with suction openings with which the bulging part of the top ply is sucked against he pipe, and the displacement and removal are brought about in this way.

It is also conceivable to use blow openings which then have to be directed in such a way that the bulging part is sucked against the pipe through the Coanda effect.

In the process according to the invention, which envisages a displacement of the plies relative to each other, the device according to the invention can be designed in such a way that the element is a plate which extends slantingly upwards forming an acute angle with the top face of the stack and having one or more blow nozzles above said plate which are directed onto the top surface of the plate.

The invention will now be explained in greater detail with reference to the drawings.

Figure 3A:
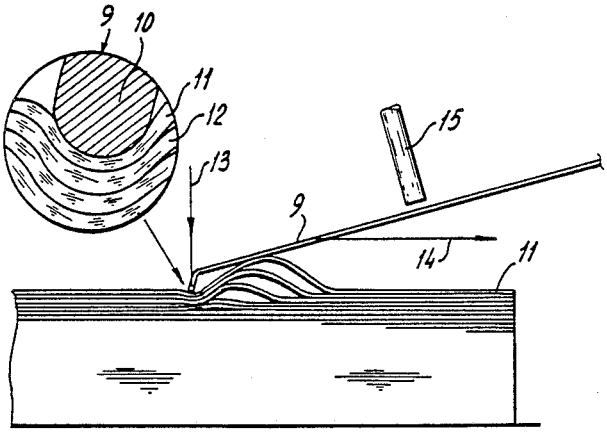
Figure 3B:
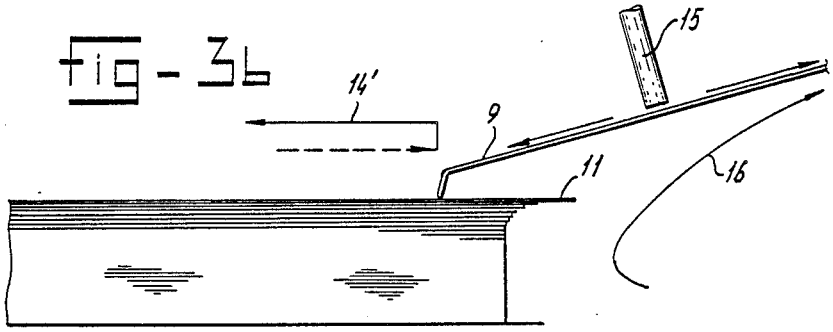
Figure 3C:
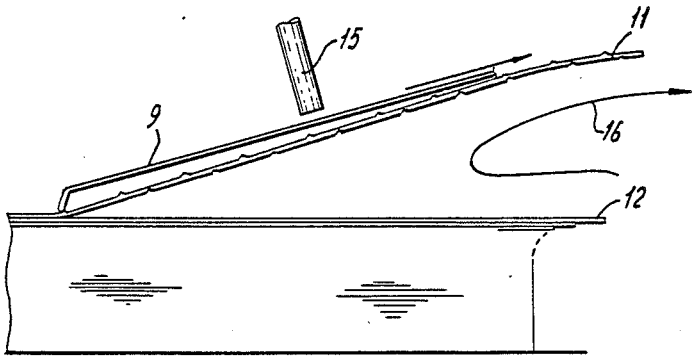

FIGS. 3*a*, 3*b*, 3*c* resp. show the bulging of a top ply with pressing load and sliding movement by means of a plate with smooth edge, the thus produced projection of the edge of the top ply from the stack and the subsequent lifting of this ply.

Figure 1:
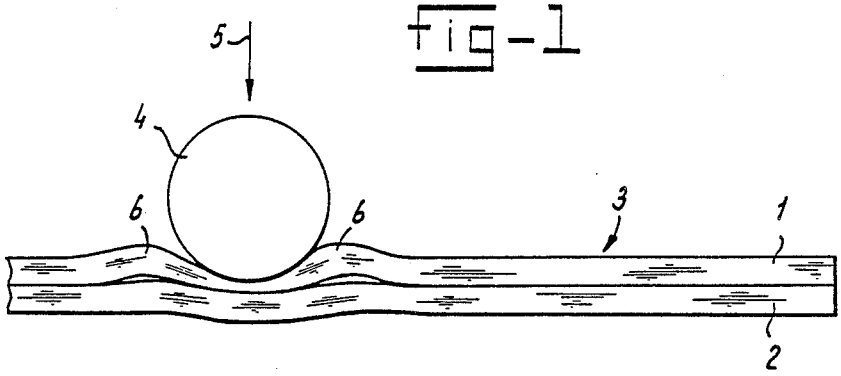
FIG. 1 shows the bulging of a top ply with static load with a hollow or other bar in side view.

FIG. 1 shows only the top ply 1 and the underlying ply 2 of the stack 3. By means of the bar 4, a force is exerted in the direction of the arrow 5 on the stack of fabric which springs in through its elastic character.

Slight bulges 6 are produced in the top ply 1, near either side of the bar which in practice prove to be insufficient, for example, to remove the top layer of fabric from the stack, since with static pressure stretching of the top ply also takes place, and this impedes the formation of folds.

Figure 2:
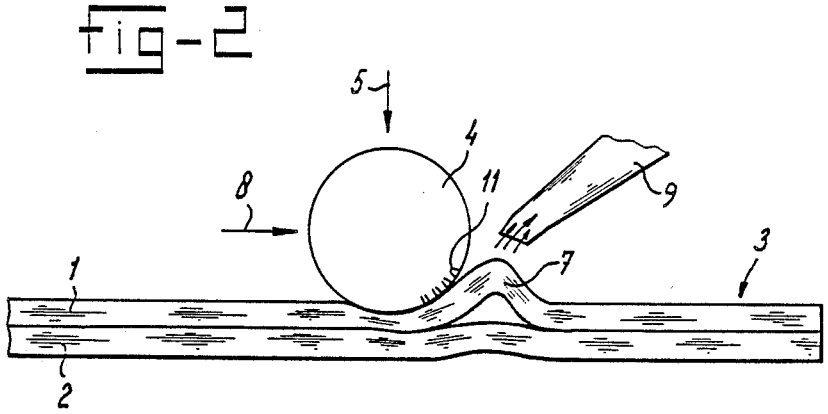
FIG. 2 shows the bulging of a top ply with pressing load and sliding movement.

FIG. 2 shows the same bar 4 with which, apart from the vertically directed force shown by the arrow 5, a horizontal force, indicated by arrow 8, occurs by means of shifting the bar 4 over ply 1. A bulging 7 now takes place at only one side, which is however, considerably greater than the bulging 6. The top layer can easily be gripped at the location of this bulging, for example by a suction nozzle 9, which can be a line suction device whose linetype opening is parallel to the axis of the bar 4. Bar 4 can also be hollow and provided with a slit or openings 11 lying in one line. Such a hollow bar or tube can be connected to a suction line, so that the top layer is drawn in through openings 11 at the location of bulging 7, possibly after turning of the pipe. If compressed air is connected to the line and flows out through the openings 11 along the cylinder wall, vacuum is produced due to the Coanda effect between the bar and the location of bulging in the top layer. If the bulging is driven up to the edge of the stack, the edge of the top layer will move upwards due to this vacuum. The edge of the top layer is then grabbed by a known technique. The bar is preferably broader than the plies. The openings can thus be either suction or blow openings.

FIG. 3, finally, shows how a plate 9 can be used instead of a bar. The plate 9 is provided with a rounded edge 10, by means of which pushing can take place over the top layer 11 of the stack in the direction of the arrow 14, with the exertion of a downward pressure according to arrow 13. FIG. 3*a* shows that in this way raising of the layers 11, 12 . . . etc. first takes place. FIG. 3*b* shows that when the plate approaches the edge of the stack the raised point disappears, because the ends of the layers 11, 12, . . . etc. move horizontally. The force 13 is then removed, the plate is moved in the opposite direction according to arrow 14', and compressed air is blown through the pipe 15 fitted above the plate 9. Due to the Bernoulli effect, the outside air will flow in the direction indicated by the arrow 16, and a vacuum is produced between the plate 9 and the top layer 11. The top layer 11 will thereby be lifted practically up to the plate 9. This layer 11 can then be grabbed by known techniques.

With the process according to the invention, it is consequently possible to remove a ply from a stack, without taking two plies together or causing damage, by detaching the ply from the plies below it with a smooth sliding element, which may or may not be combined with a blowing system.

We claim:

1. A process for removing the top layer from an elastically compressible stack of layers of fiber material by having an element engage the top layer of the stack and move said element in the plane of said top layer, the improvement being that the element engages the top layer with a smooth surface which has a friction upon said top layer which is less than the friction between the top layer of the stack and the next layer below the top layer, which element is pressed upon the stack in such a way that the stack is locally dented, in which position the element is moved over in pressing contact with the stack from an initial position on top of the stack towards an edge of the stack, after which the element is returned free from said top layer, while a vacuum is produced above the top layer by means of a jet of air directed onto a plate arranged with an upward inclination with respect to the element in the direction of said edge in such a way that the top layer is lifted by the vacuum.

2. A process as claimed in claim 1, wherein the element is the lower edge of the plate, which plate extends upwards in sloping fashion forming an acute angle with the top face of the stack and above said plate are one or more blow nozzles which are directed onto the top face of said plate.

3. A process for removing a top layer from an elastically compressible stack of layers of fabric material by using an element having a smooth fabric engaging surface providing a friction between said element and the top fabric layer to be removed which is less than the friction between the layers of fabric in the stack, comprising pressing the element against the top layer of the stack in such a way that at least the top layer is locally dented and a bulge is formed in said top layer on either side of the element, moving said element in this position parallel to the plane of the top layer of the stack such that the bulge downstream of the direction of movement is increased and upstream of the direction of movement decreased and using the enlarged bulge for picking up the top layer.

4. A device for effecting the removal of a top layer from an elastically compressible stack of layers of fabric, comprising a single rod-shaped element with a lower smooth surface for engagement with the top layer of the stack, which element has been provided with pneumatic openings and of which the smooth lower surface presents a surface friction in engagement with the top layer of the stack of fabric which is less than the friction between the individual layers of fabric, means being provided for moving said element downwardly to press upon the stack and dent it along the length of the element and for subsequently moving said element horizontally with the pneumatic openings directed toward the bulge formed in the top layer downstream the horizontal direction of movement.

* * * * *